US009962753B2

(12) United States Patent
Lerch et al.

(10) Patent No.: US 9,962,753 B2
(45) Date of Patent: May 8, 2018

(54) TOOL FOR PREFORMING A TUBE FOR SUBSEQUENT INTERNAL HIGH PRESSURE FORMING, AS WELL AS A METHOD FOR PRODUCING SUCH A TOOL AND FOR PRODUCING A COMPONENT BY INTERNAL HIGH PRESSURE FORMING

(71) Applicant: Bayerische Motoren Werke Aktiengesellschaft, Munich (DE)

(72) Inventors: Johann-Stefan Lerch, Hohenwart (DE); Thomas Schmolke, Vilsbiburg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 246 days.

(21) Appl. No.: 14/877,381

(22) Filed: Oct. 7, 2015

(65) Prior Publication Data

US 2016/0023261 A1 Jan. 28, 2016

Related U.S. Application Data

(63) Continuation of application No. PCT/EP2014/063275, filed on Jun. 24, 2014.

(30) Foreign Application Priority Data

Jun. 28, 2013 (DE) ..... 10 2013 212 758

(51) Int. Cl.
*B21D 26/02* (2011.01)
*B21D 26/047* (2011.01)
(Continued)

(52) U.S. Cl.
CPC ..... *B21D 26/047* (2013.01); *B21D 26/02* (2013.01); *B21D 26/033* (2013.01); *B21D 37/10* (2013.01)

(58) Field of Classification Search
CPC .... B21D 26/047; B21D 26/033; B21D 26/02; B21D 37/10
(Continued)

(56) References Cited

U.S. PATENT DOCUMENTS 4,567,743 A 2/1986 Cudini
5,339,667 A 8/1994 Shah et al.
(Continued)

FOREIGN PATENT DOCUMENTS

CN 1264326 A 8/2000
CN 1644264 A 7/2005
(Continued)

OTHER PUBLICATIONS

Chinese Office Action issued in counterpart Chinese Application No. 201480024391.9 dated Jun. 1, 2016, with English translation (sixteen (16) pages).
(Continued)

*Primary Examiner* — David B Jones
(74) *Attorney, Agent, or Firm* — Crowell & Moring LLP

(57) ABSTRACT

A tool is provided for preforming a metallic starter tube section for subsequent internal high pressure forming in order to produce a tubular IHF-component. The tool includes a plurality of tool sections that can move relative to one another and that delimit, between them, a shaping cavity for receiving and forming the starter tube section. The cavity has a contour which is both derived from the shape of the IHF component to be produced and adapted to the circumference of the starter tube section to be formed, such that each cavity cross section perpendicular to a cavity longitudinal axis predefined by the starter tube section corresponds to the cross-sectional shape of the IHF component cross-section in the same position, reduced in its cross-sectional circumference to exactly the circumference of the starter
(Continued)

tube section. A method is provided for producing such a tool, and a method is provided for producing a tube-like IHF component using such a tool.

17 Claims, 2 Drawing Sheets

(51) Int. Cl.
*B21D 37/10* (2006.01)
*B21D 26/033* (2011.01)

(58) Field of Classification Search
USPC ..... 72/61
See application file for complete search history.

(56) References Cited

U.S. PATENT DOCUMENTS

| | | | | |
|---|---|---|---|---|
| 5,987,950 | A | 11/1999 | Horton | |
| 8,443,642 | B2 * | 5/2013 | Golovashchenko | B21D 22/025 29/421.1 |
| 2004/0048013 | A1 | 3/2004 | Gehrig et al. | |
| 2012/0285213 | A1 * | 11/2012 | Golovashchenko | B21D 26/033 72/61 |

FOREIGN PATENT DOCUMENTS

| | | | |
|---|---|---|---|
| DE | 42 14 557 | C2 | 2/1994 |
| DE | 199 46 010 | A1 | 3/2001 |
| DE | 101 48 451 | C2 | 12/2002 |
| DE | 199 46 010 | B4 | 1/2006 |
| DE | 10 2006 028 099 | A1 | 12/2007 |
| EP | 195 157 | A2 | 9/1986 |
| EP | 195 157 | B1 | 12/1989 |

OTHER PUBLICATIONS

International Search Report (PCT/ISA/210) issued in PCT Application No. PCT/EP2014/063275 dated Sep. 15, 2014, with English translation (six (6) pages).

German Search Report issued in counterpart German Application No. 10 2013 212 758.8 dated Sep. 9, 2014, with partial English translation (thirteen (13) pages).

* cited by examiner

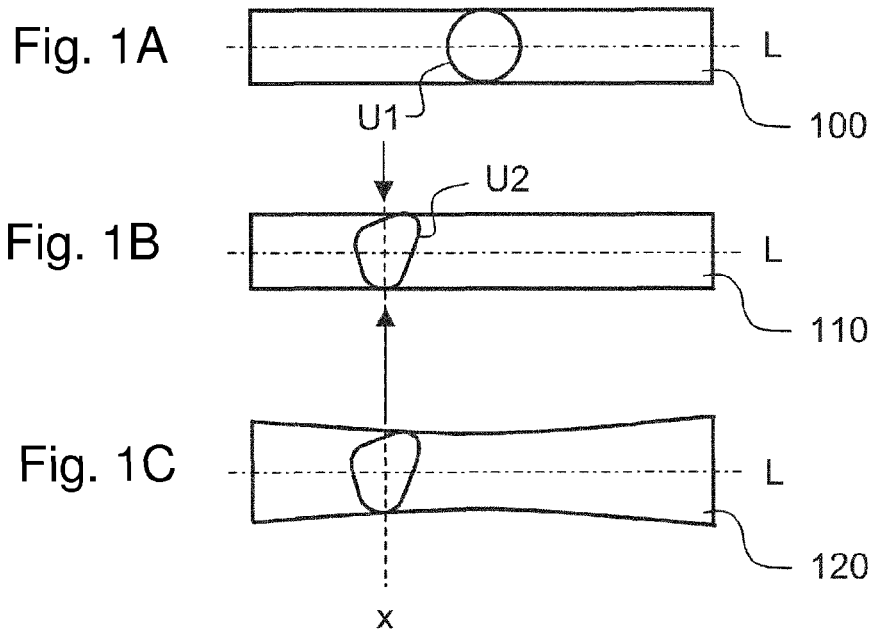
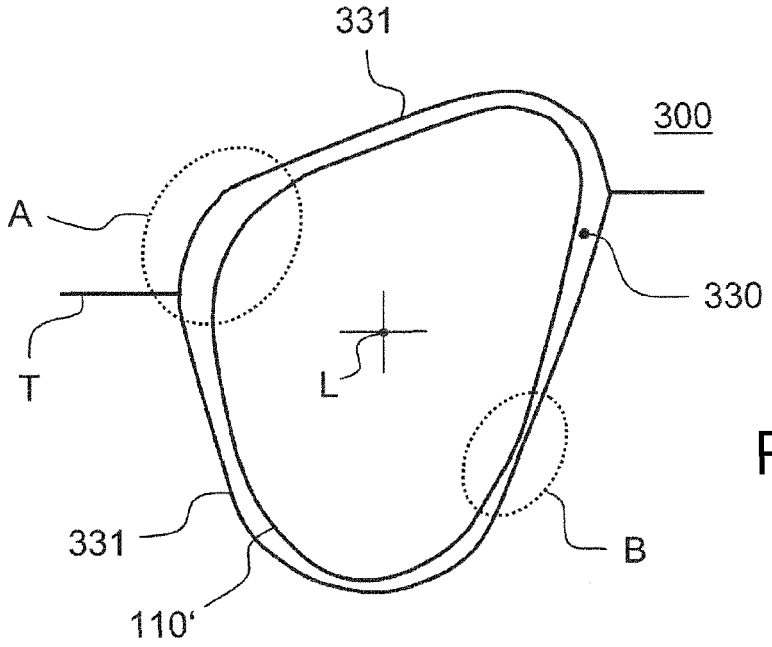
Prior Art
Fig. 2

TOOL FOR PREFORMING A TUBE FOR SUBSEQUENT INTERNAL HIGH PRESSURE FORMING, AS WELL AS A METHOD FOR PRODUCING SUCH A TOOL AND FOR PRODUCING A COMPONENT BY INTERNAL HIGH PRESSURE FORMING

CROSS REFERENCE TO RELATED APPLICATIONS

This application is a continuation of PCT International Application No. PCT/EP2014/063275, filed Jun. 24, 2014, which claims priority under 35 U.S.C. § 119 from German Patent Application No. 10 2013 212 758.8, filed Jun. 28, 2013, the entire disclosures of which are herein expressly incorporated by reference.

BACKGROUND AND SUMMARY OF THE INVENTION

The invention relates to a tool for preforming a metallic starter tube section for subsequent internal high pressure forming.

The invention also relates to a method for producing such a tool.

The invention further relates to a method for producing a tube-like component by internal high pressure forming.

In internal high pressure forming (IHF), an essentially metallic tube, referred to below as the starter tube section, is formed into a tube-like component (IHF component) by the application of a high internal pressure. The expression "a tube" is generally understood to denote a longitudinally extending hollow body having a closed tube casing made from a metallic material. The starter tube section is inserted for this purpose into the cavity (engraving) of a shaping IHF tool and is opened out essentially transversely to the longitudinal axis by use of a fluid (e.g. a water/oil emulsion) introduced into the interior, wherein the tube casing of the starter tube section is pressed against the cavity wall and is shaped accordingly in the process.

Frequently, and in particular in the case of a complex shape of the IHF component, preforming is initially necessary, wherein a preformed starter tube section for the subsequent internal high pressure forming is produced from the starter tube section in the IHF tool. Preforming has a considerable influence on the following internal high pressure forming and on the quality of the IHF component.

Various procedures and apparatuses for preforming are familiar from the prior art, in respect of which reference is made to patent specifications DE 10 2006 028 099 A1, DE 101 48 451 C2, DE 199 46 010 B4 and EP 0 195 157 B1.

The object of the invention is to provide a tool for preforming a metallic starter tube section, which permits an optimal distribution of the tube material with a view to subsequent internal high pressure forming. The object of the invention is further to provide an optimized method for the production of a tube-like IHF component.

This and other objects are achieved by, in accordance with embodiments of the invention, providing a tool for preforming a tube for subsequent internal high pressure forming, and methods for producing such a tool and for producing an internal high pressure formed component.

A tool according to the invention for preforming a metallic starter tube section for subsequent internal high pressure forming for the production of a tube-like IHF component has a plurality of tool components with the ability to move relative to one another, which between them delimit (at least) one cavity for receiving and forming the starter tube section. According to the invention, it is proposed that the cavity has a contour which is both derived from the shape (or geometry) of the IHF component to be produced and is adapted to the circumference of the starter tube section to be formed, such that each cavity cross section of this cavity perpendicular to a cavity longitudinal axis predefined by the starter tube section conforms to the cross-sectional shape of the IHF component cross section in the same position (relative to the longitudinal axis), reduced in its cross-sectional circumference to exactly the circumference of the starter tube section.

In other words, this means that the cross-sectional shape of each cavity cross section, along a cavity longitudinal axis predetermined by the starter tube section, corresponds to the reduced cross-sectional circumference of the cross section of the IHF component in the same position or in the same location relative to the longitudinal axis, wherein the cross-sectional circumference of each cavity cross section in each case conforms exactly to the circumference of the starter tube section, however.

The cross-sectional geometry of a cross section consists essentially of the shape or the cross-sectional shape and the circumference or the cross-sectional circumference, from which an appropriate area or cross-sectional area results.

The cavity of the tool according to the invention has a cavity longitudinal axis that is predetermined by the starter tube section, wherein the cavity longitudinal axis is essentially identical to the longitudinal axis of an inserted starter tube section. It is proposed according to the invention that the respective cavity cross section at every point or at every location on this cavity longitudinal axis exhibits a reduced cross-sectional shape of the IHF component to be produced relative to an IHF component cross section at the same point on the longitudinal axis, wherein the respective cross-sectional circumference corresponds exactly to the circumference of the starter tube section, however. The circumference of the starter tube section thus determines at each point the scaling factor for the reduction of the cross-sectional shape of the respective IHF component cross-section (in which case the scaling factor must be $\leq 1$). Compared with the IHF component to be produced or compared with the cavity of the shaping IHF tool, the cavity of the tool according to the invention thus exhibits a variable offset along its cavity longitudinal axis, wherein the respective offset dimension is obtained from the scaling factor.

Each cross section of a starter tube section that has been preformed with this tool has the same distance or a constant distance to the cavity wall of the IHF tool along its circumference in the course of subsequent internal high pressure forming inside an IHF tool. In the course of internal high pressure forming, viewed over the circumference, an approximately uniform forming and stretching of the tube material and thus an excellent material utilization is achieved in this way. This gives rise to many advantages for the IHF process and for the properties of the IHF component. For example, the IHF component that has been produced in this way essentially exhibits a uniform wall thickness.

The preforming of a starter tube section that is present inside the cavity of the tool according to the invention takes place in particular such that at least one of the parts of the tool is displaced relative to at least one of the other parts of the tool. The design features according to the invention for the cavity relate primarily to a final shaping state of the cavity at the end of the forming process, wherein the parts of the tool in particular exhibit the smallest possible distance to each other. The contour of the cavity (or the cavity contour) can be defined as the totality of the geometrical design features of the cavity wall.

Since the cross-sectional circumference of each cavity cross section on the cavity longitudinal axis corresponds exactly to the circumference of the starter tube section, defined, accurate and compression-free forming or preforming of the starter tube section takes place at every point. Indefinite forming is avoided. With regard to the subsequent internal high pressure forming, a starter tube section that has been preformed with the tool according to the invention exhibits an essentially optimal preform and, associated therewith, optimal distribution of the tube material.

It is proposed that the tool according to the invention is preferably a press-based tool having a tool lower part and having a tool upper part that is capable of movement relative thereto. The tool can be opened and closed by raising and lowering the tool upper part. Forming or preforming of a starter tube section that is present inside the cavity is effected by the application of a pressing force, with the tool closed, in conjunction whereby the starter tube section assumes the preform that is predetermined by the contour of the cavity.

A method according to the invention for producing a tool according to the invention for preforming a metallic starter tube section for subsequent internal high pressure forming comprises essentially the following steps:

a.) provision of the geometrical data determining the shape (overall shape) of the IHF component to be produced or alternatively the geometrical data of the cavity of the IHF tool;

b.) determination of the circumference and, if necessary, the cross-sectional shape of the starter tube section to be used, for which purpose, for example, the smallest cross section of the IHF component is considered and, on the basis of its cross-sectional circumference, in particular less 3%, the circumference of the starter tube section is determined;

c.) calculation of the contour of a shaping cavity required for the preforming of the starter tube section by use of guide sections, for which purpose transverse sections are produced initially along the longitudinal axis of the IHF component (or alternatively along the longitudinal axis of the cavity of the IHF tool), and these are then reduced or scaled respectively in respect of their circumference to the calculated circumference of the starter tube section, wherein the guide sections obtained in this way can subsequently be brought together, in order to determine the contour of the cavity therefrom; and d.) manufacture of the tool with a cavity exhibiting this contour.

This method can include further steps and/or intermediate steps. It is proposed that steps a., b. and c., in particular being automated, are preferably executed with a CAD program or the like, that is to say with the help of computer equipment.

A method according to the invention for producing a tube-like IHF component by internal high pressure forming comprises at least the following steps:

a.) provision of a starter tube section, being in particular a starter tube section having a defined axial length cut to length from a semi-finished product;

b.) preforming and, in particular, kink-free preforming of the starter tube section in a tool according to the invention for preforming; and c.) internal high pressure forming of the preformed starter tube section in an IHF tool.

The individual steps and the devices or tools used for that purpose are matched to one another. The proposed method can include further steps and/or intermediate steps, of which a number are explained in more detail below.

It is proposed that the starter tube section is preferably pre-bent in a step preceding the preforming operation, essentially without changing any cross section. The bending or pre-bending leads to a tool longitudinal axis having an uneven and preferably complex, although in particular kink-free, spatial course, which corresponds in particular at least approximately to the IHF component to be produced (as illustrated, for example, in EP 0 195 157 B1). The pre-bending also serves to ensure, among other things, that, for the purpose of its preforming, the pre-bent starter tube section can be inserted in line with the shape into the cavity of the tool.

The starter tube section is preferably produced from an aluminum material or a steel material. However, the starter tube section can also be produced from other materials (e.g. brass).

The starter tube section preferably exhibits a circular or oval cross section or a circular or oval cross-sectional shape (in relation to the external shape). The starter tube section can also exhibit other cross-sectional shapes (for example a polygonal shape).

It is further proposed that, in conjunction with internal high pressure forming in the IHF tool, different degrees of circumferential stretching due to plastic material deformation are achieved preferably over the longitudinal axis of the preformed starter tube section, which in particular lie in a range between 3% and 10%. Typically, the circumferential stretching may be greater at the ends of the tube and may have a value of up to 10% at that point, whereas the smaller circumferential stretching in the central sections of the tube should have a value of at least 3%. Forming without heat treatment is possible, in particular in combination with the previously mentioned materials, in the case of circumferential stretching in the aforementioned region. Deformation with a tool according to the invention makes higher circumferential stretching or circumferential enlargement possible to some extent in conjunction with internal high-pressure forming, depending on the nature of the material, than with the procedures that are familiar from the prior art.

The preformed starter tube section is preferably inserted into the cavity of the IHF tool in such a way that it exhibits the same distance to the cavity wall of the IHF tool over the respective cross-sectional circumference at every point on its longitudinal axis, i.e. in such a way that it is surrounded by a gap of uniform width, wherein the distance or the width of the gap may vary depending on the position of the respective cross section on the longitudinal axis. As already described above, approximately uniform forming and thinning due to stretching of the tube material, associated with excellent material utilization, are obtained as a result when observed over the circumference, in conjunction with internal high-pressure forming. The IHF tool can exhibit suitable positioning elements.

The IHF component to be produced is, in particular, a motor vehicle component, in particular such as a body component (for example, an internal reinforcement part) or an axial part (for example, a longitudinal member or a transverse member). There is thus a preference for both a tool according to the invention for preforming and a method according to the invention for producing a tube-like IHF component to be used for producing a motor vehicle component.

Other objects, advantages and novel features of the present invention will become apparent from the following detailed description of one or more preferred embodiments when considered in conjunction with the accompanying drawings.

BRIEF DESCRIPTION OF THE DRAWINGS

FIGS. 1A-1C depict, in each case, in a side view a stage of a tube-like workpiece in the course of the production of an IHF component;

FIG. 2 depicts in a sectioned view a starter tube section preformed according to the prior art and inserted into the cavity of an IHF tool prior to internal high-pressure forming;

DETAILED DESCRIPTION OF THE DRAWINGS

Figure 3:
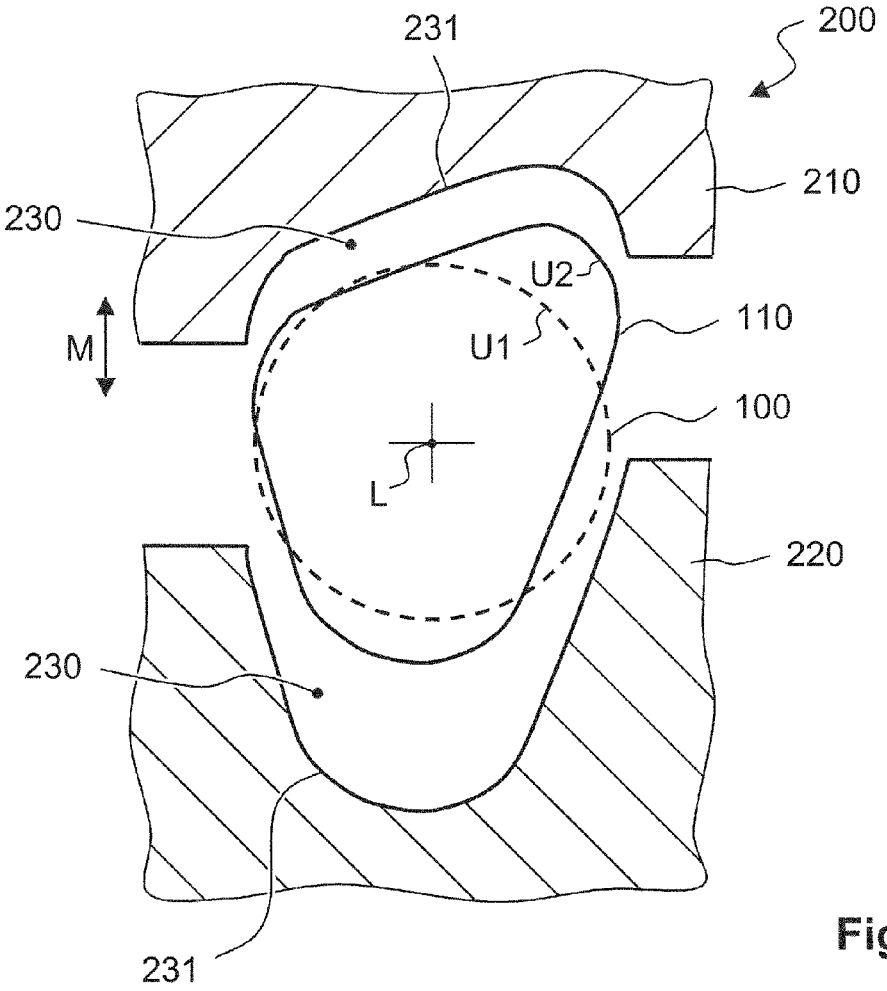
FIG. 3 depicts a partial section of a tool according to an embodiment of the invention for preforming a starter tube section.

FIG. 1*a* depicts a metallic starter tube section or starter tube piece 100. The starter tube section 100 has a constant circular cross section (in relation to the external shape) along its longitudinal axis L having the circumference U1 and a uniform wall thickness. The starter rube section 100 is made, for example, from an aluminum material or a steel material.

The starter tube section 100 serves as a workpiece, which is subsequently formed into the tube-like IHF component 120 depicted in FIG. 1*c* produced by internal high pressure forming. The starter tube section 100 is preformed initially for this purpose, wherein only its cross-sectional shape is changed and is adapted to the contour of the cavity of the IHF tool, as described in more detail below. FIG. 1*b* depicts the preformed starter tube section 110, which exhibits a cross-sectional circumference U2. The respective longitudinal axis is designated with L both for the starter tube section 100 and for the preformed starter tube section 110 and the IHF component 120.

The IHF component 120 is configured along its longitudinal axis L with different cross-sectional geometries, so that the cross sections differ with regard to their cross-sectional shape and/or their cross-sectional circumference. For example, the circumferential stretching that is achieved at the axial ends of the component of the IHF component 120 depicted in FIG. 1*c* in conjunction with internal high pressure forming is in the order of approximately 10% and approximately 3% in the central region.

The IHF component 120 may, in contrast to the example depicted in FIG. 1*c*, have a complex, spatially multiply bent and/or curved longitudinal course, as depicted in EP 0 195 157 B1, for example. In this case in particular, provision may be made for the starter tube section 100 to be bent or pre-bent initially prior to preforming, as already explained above. The following explanations also relate to this case in an analogous manner.

FIG. 2 depicts by way of example, in a schematic sectional view at the location x of the longitudinal axis L (see FIG. 1), a starter tube section 110' preformed according to the prior art and inserted into the cavity 330 of a multi-part IHF tool 300 prior to internal high-pressure forming. The preformed starter tube section 110' exhibits, at least at the indicated location, a cross-sectional geometry which approximates that of the IHF component 120 to be produced. In the course of the internal high-pressure forming, the tube casing of the preformed starter tube section 110' is pressed against the cavity wall 331 and is shaped according to the contour of the cavity wall 331 in the process, as explained by way of the introduction.

During the internal high-pressure forming, a high degree of forming of the preformed starter tube section 110' takes place in the corner region identified with A, which is associated with a high degree of thinning of the casing material and possibly with the formation of a crack or a tear, whereas only a low degree of forming takes place in the region identified with B. The IHF component 120 that is produced accordingly exhibits different wall thicknesses along its circumference, which entails various disadvantages.

Reference is also made below in this respect to the corresponding explanations in the prior art (see, for example, DE 10 2006 028 099 A1, paragraphs [0061] and [0062], and DE 199 46 010 B4, paragraphs [0042], [0043], [0052] and [0053]).

In order to eliminate the disadvantages associated with the prior art, the cavity 230 of a tool 200 according to the invention (see FIG. 3) exhibits, for the purpose of preforming the starter tube section 100, a contour that is both derived from the shape of the IHF component 120 to be produced and is also adapted to the circumference U1 of the starter tube section 100 to be formed. It is also proposed that the cross-sectional shape of every cavity cross section corresponds in each case, along a cavity longitudinal axis L determined by the starter tube section 100, to the reduced cross-sectional shape of the IHF component cross section situated in the same position, wherein the circumference of each cavity cross section respectively conforms exactly to the circumference U1 of the starter tube section 100.

This can be appreciated clearly from FIG. 1. The cross-sectional geometry for the preformed starter tube section 110 arises at the location x on the longitudinal axis L, as indicated by the arrows, wherein this cross-sectional geometry is essentially identical to the cross-sectional geometry of the shaping cavity 230 of the preforming tool 200, from the cross-sectional shape of the IHF component 120 at the same location x, and from the circumference U1 of the starter tube section 100, with the result that: U1=U2. This is also the case for every other location on the longitudinal axis L. It is generally the case that the geometry of the preformed starter tube section 110 is essentially identical to the cavity geometry 230 of the preforming tool 200.

Every cavity cross section of the cavity 230 that is perpendicular to a cavity longitudinal axis L determined by the starter tube section 100 thus conforms to the cross-sectional shape of the IHF component cross section in the same position that has been reduced exactly in respect of its cross-sectional circumference to the circumference of the starter tube section 100, or is identical therewith.

FIG. 3 depicts a tool 200 according to the invention for preforming the starter tube section 100 in a sectioned representation at the location x (see FIG. 1). The tool 200, when installed in a press, comprises a tool under part 220 and a tool upper part 210 that is capable of displacement relative thereto, which parts in the closed state between them delimit the cavity 230 for receiving and forming the starter tube section 100. The cross-sectional geometry of the cavity 230 at the indicated location arises as previously described. The displacement of the tool upper part 210 is indicated by the double arrow M.

For the purpose of preforming, the starter tube section 100 is inserted into the cavity 230 with the tool 200 opened. The tool 200 is then closed by lowering the tool upper part 210, in conjunction with which the starter tube section 100 that is present in the cavity 230 is formed into the preformed starter tube section 110 by the application of a pressing force without a change to the circumference (i.e. U2=U1). Since the contour of the cavity 230 is adapted exactly to the circumference of the starter tube section 110, defined, accurate and compression-free forming of the starter tube section 100 takes place both at the indicated location and at any other location.

The preforming process in a tool 200 according to the invention can be described as die forming, wherein this preforming is able to take place in particular without supporting pressure, and also with supporting pressure where appropriate, and in particular with low supporting pressure (so-called pressure-assisted low-pressure preforming). The preformed starter tube section 110 can be removed after opening the tool 200 and can subsequently be inserted directly into the IHF tool 300 for internal high-pressure forming.

Figure 4:
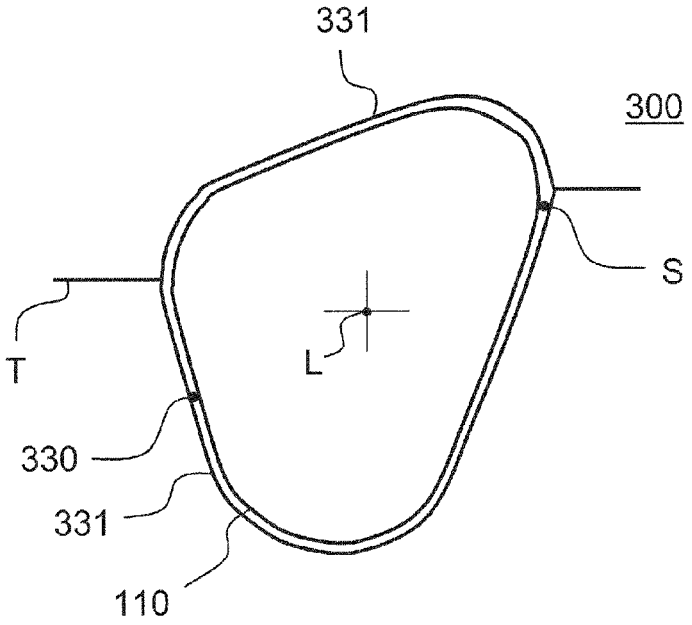
FIG. 4 depicts in a sectioned view a starter tube section preformed with the tool depicted in FIG. 3 and inserted into the cavity of an IHF tool prior to internal high-pressure forming.

FIG. 4 depicts in a sectioned representation at the location x the starter tube section 110 preformed with the tool 200 according to the invention and inserted into the cavity 330 of an IHF tool 300 prior to internal high-pressure forming. The preformed starter tube section 110 does not bear against the cavity wall 331 of the IHF tool 300, but has a constant distance from the cavity wall 331 over its entire cross-sectional circumference, so that a circumferential and essentially uniformly wide gap S is present between the tube casing of the preformed starter tube section 110 and the cavity wall 331. Accordingly, in the case of internal high-pressure forming, the preformed starter tube section 110 is opened out and is formed essentially uniformly, as a result of which a uniform wall thickness is obtained over the circumference. The plastic circumferential stretching to be achieved at this axial location in the course of internal high-pressure forming is determined by the gap width of the gap S. The gap width of the gap S may vary along the longitudinal axis L, depending on the shape of the IHF component 120.

LIST OF REFERENCE DESIGNATIONS

100 starter tube section
110 preformed starter tube section
120 IHF component
200 tool for preforming
210 tool upper part
220 tool lower part
230 cavity
231 cavity wall
300 IHF tool
330 cavity
331 cavity wall
A region
B region
L longitudinal axis
M opening/closing movement
S gap
T parting plane
U1 circumference of the starter tube section
U2 circumference of the preformed starter tube section, or cross-sectional circumference of the cavity cross section at the same location
x position (or location) on the longitudinal axis The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A tool for preforming a metallic starter tube section for subsequent internal high pressure forming in order to produce a tubular IHF component, the tool comprising:

a plurality of tool parts configured to move relative to one another, said plurality of tool parts between them delimiting a shaping cavity that receives and forms the starter tube section, wherein the shaping cavity has a contour both derived from a shape of the tubular IHF component to be produced and adapted to a circumference of the starter tube section to be preformed, the shaping cavity is structurally configured such that each cavity cross-section of the shaping cavity perpendicular to a cavity longitudinal axis conforms to a cross-sectional shape of the tubular IHF component cross-section, and the shaping cavity has a cross-sectional circumference that corresponds exactly to the circumference of the starter tube section.

2. The tool according to claim 1, wherein the tool is a press-based tool, and the plurality of tool parts comprise a tool underpart and a tool upper part relatively movable with respect to one another.

3. A method for producing a tool for preforming a metallic starter tube section for subsequent internal high pressure forming in order to produce a tubular IHF component, the tool comprising a plurality of tool parts configured to move relative to one another, said plurality of tool parts between them delimiting a shaping cavity that receives and forms the starter tube section, wherein the shaping cavity has a contour both derived from a shape of the tubular IHF component to be produced and adapted to a circumference of the starter tube section to be preformed, and each cavity cross-section of the shaping cavity perpendicular to a cavity longitudinal axis predefined by the starter tube section conforms to a cross-sectional shape of the tubular IHF component cross-section in a same position, but reduced in its cross-sectional circumference to exactly the circumference of the starter tube section;

the method comprising the acts of:

providing geometrical data determining a shape of the tubular IHF component to be produced;

determining the circumference of the starter tube section to be preformed;

calculating the contour of the shaping cavity required to preform the starter tube section by use of guide sections, for which purpose transverse sections are produced initially along the longitudinal axis of the tubular IHF component, and said transverse sections are then reduced in circumference to the determined circumference of the starter tube section to be preformed; and manufacturing the tool with the shaping cavity having the calculated contour.

4. The method according to claim 3, wherein the acts of providing, determining, and calculating are carried out automatically via a CAD program.

5. A tool for preforming a metallic starter tube section made in accordance with the method of claim 3.

6. A method for producing a tubular IHF component via internal high pressure forming, the method comprising the acts of:

providing a starter tube section;

preforming the starter tube section in a tool having a plurality of tool parts movable relative to one another and between which delimit a shaping cavity for receiving and preforming the starter tube section, wherein the shaping cavity has a contour both derived from a shape of the tubular IHF component to be produced and adapted to a circumference of the starter tube section to be preformed, and each cavity cross-section of the shaping cavity perpendicular to a cavity longitudinal axis predefined by the starter tube section conforms to a cross-sectional shape of the tubular IHF component cross-section in a same position, but reduced in its cross-sectional circumference to exactly the circumference of the starter tube section;

performing internal high pressure forming of the preformed starter tube section in an IHF tool in order to produce the tubular IHF component.

7. The method according to claim 6, further comprising the act of:

first bending the starter tube section prior to preforming the starter tube section.

8. The method according to claim 7, wherein the starter tube section is formed of an aluminum or steel material and has a circular or oval cross-section.

9. The method according to claim 6, wherein the starter tube section is formed of an aluminum or steel material and has a circular or oval cross-section.

10. The method according to claim 6, wherein different circumferential stretching lying within a range of between 3% and 2% is achieved over the longitudinal axis of the preformed starter tube section during the performance of the internal high pressure forming.

11. The method according to claim 7, wherein different circumferential stretching lying within a range of between 3% and 2% is achieved over the longitudinal axis of the preformed starter tube section during the performance of the internal high pressure forming.

12. The method according to claim 8, wherein different circumferential stretching lying within a range of between 3% and 2% is achieved over the longitudinal axis of the preformed starter tube section during the performance of the internal high pressure forming.

13. The method according to claim 6, wherein the preformed starter tube section is inserted into a cavity of the IHF tool such that a same distance to a cavity wall exists at every point on the longitudinal axis over a respective cross-sectional circumference.

14. The method according to claim 12, wherein the preformed starter tube section is inserted into a cavity of the IHF tool such that a same distance to a cavity wall exists at every point on the longitudinal axis over a respective cross-sectional circumference.

15. The method according to claim 6, wherein the tubular IHF component produced is a motor vehicle component.

16. The method according to claim 14, wherein the tubular IHF component produced is a motor vehicle component.

17. A tool for preforming a metallic starter tube section made in accordance with the method of claim 6.

* * * * *